United States Patent [19]

Heyse

[11] Patent Number: 4,933,071

[45] Date of Patent: Jun. 12, 1990

[54] IRON REMOVAL FROM HYDROCARBONACEOUS FEEDSTOCK

[75] Inventor: John V. Heyse, Crockett, Calif.

[73] Assignee: Chevron Research Company, San Francisco, Calif.

[21] Appl. No.: 345,382

[22] Filed: Apr. 28, 1989

[51] Int. Cl.[5] ..... C10G 45/04

[52] U.S. Cl. ..... 208/251 R; 208/48 R; 208/88; 208/217; 423/139; 423/140

[58] Field of Search ..... 208/48 R, 251 R, 88, 208/212, 217; 423/139, 140

[56] References Cited

U.S. PATENT DOCUMENTS

| | | | |
|---|---|---|---|
| 2,854,399 | 9/1958 | Weller | 208/251 R |
| 3,573,201 | 3/1971 | Annesser et al. | 208/251 H |
| 4,614,643 | 9/1986 | Doanne | 423/140 |
| 4,836,914 | 6/1989 | Inoue et al. | 423/140 |

*Primary Examiner*—Helane Myers

*Attorney, Agent, or Firm*—T. G. De Jonghe

[57] ABSTRACT

A process is disclosed for the removal of iron from hydrocarbonaceous feedstock comprising passing the feedstock over inert, fibrous material in the presence of sulfur to induce the deposition of iron sulfide on the fibrous material through autocatalytic homoepitaxy.

11 Claims, No Drawings

IRON REMOVAL FROM HYDROCARBONACEOUS FEEDSTOCK

BACKGROUND OF THE INVENTION

Some important petroleum crude feedstocks, residua, and deasphalted oil derived from them, contain levels of iron which render them difficult to process effectively using conventional refining techniques. Among those iron contaminants causing particular problems are those found in the form of nonporphyrin, organometallically-bound compounds. These species have been attributed to either iron complexes naturally present in the crude or to solubilized iron produced from corrosion and decay of iron-bearing equipment which comes in contact with crude oils. One possible class of iron-containing compounds identified in particular is the respective naphthenates and their homologous series. These organometallic compounds are not separated from the feedstock by normal processes, and in a conventional refining technique they can cause the very rapid deactivation of hydroprocessing catalysts, in addition to plugging and heat transfer fouling of furnace and heat exchange tubes. Examples of feedstocks demonstrating objectionably high levels of iron include those from the San Joaquin Valley in Calif., generally contained in a pipeline mixture referred to as San Joaquin Valley crude or residuum.

The iron contaminants in these crudes can cause significant deleterious effects in various catalytic processes to which the feed is subjected. In particular, metals can seriously deactivate the catalysts used in these processes, as well as causing serious plugging of fixed or other type catalyst beds due to the deposition of iron sulfides in the interstitial space between the catalyst particles in the bed. Furthermore, precipitation of iron sulfides on heat exchanger and furnace tubes can cause plugging problems and heat transfer loss. Heat transfer loss can force operations of a catalyst bed at higher temperatures, thereby accelerating catalyst deactivation even further.

One known method for substantially reducing the metals in the feed to a hydrocracker uses a guard bed in a first reaction zone ahead of the the hydrocracker reactor, U.S. Pat. No. 3,365,389, Spars et al. According to the patent, the first reaction zone is maintained at a temperature of above about 820° F. and at a pressure of between 1,000 and 5,000 psig. This has the disadvantage of requiring high temperatures and pressures, as well as the relatively high pressure drop through the guard bed after metals are preferentially deposited in the upper part of the bed. Furthermore, when these catalyst particles are spent, the feed metals concentrations across individual pellets are observed to be high at the outside and low toward the inside. Thus these catalysts are not efficiently used; some reactor volume is wasted, principally that occupied by the interiors of the catalyst particles. Moreover, these catalysts are expensive, typically costing several dollars per pound.

Prior art processes often also require high temperature and high hydrogen pressure, each of which introduces its own process difficulties. For example, U.S. Pat. No. 3,573,201 teaches a process for the removal of iron using contact particles such as hydrogenation catalysts or inorganic oxides. The process is conducted at both high temperatures (600° F. and above), high pressures (200 to 5000 psig) and in the presence of hydrogen.

It is desirable then to provide a simple method for removing these organic iron compounds, without the process limitations of high temperature and high hydrogen pressure.

SUMMARY OF THE INVENTION

The present invention provides a novel method for removing organic iron compounds from feed prior to introduction into a catalytic reactor. Specifically, the invention provides an system for demetalation that allows high metals loadings to be achieved at low to moderate temperatures and pressures and in the absence of hydrogen. This system uses a basically inert and non-porous material, preferably fibrous, as a support for the in situ deposit of the iron contaminants. The support material can be packed into a reactor or within containers which can be introduced into a reactor. The lack of hydrogen requirement allows for flexibility in locating the reactor(s), as well as eliminating a costly and often difficult-to-handle process requirement.

The process comprises passing hydrocarbonaceous feedstock over a solid, inert fibrous material in a low pressure metals removal reaction zone, in the absence of hydrogen and at a temperature in the range of 250° F. to 600° F., wherein the iron reacts with sulfur to form iron sulfide in the presence of the fibrous material, and the iron sulfide deposits on the fibrous material and subsequently on the iron sulfide itself, thereby substantially removing all of the contaminating iron from the feedstock. The deposition of the iron sulfide on itself is a process known as autocatalytic homoepitaxy. The preferred fibrous material, preferably having sufficient surface area to autocatalytically induce the formation of iron sulfide and subsequent homoepitaxial deposition of the iron sulfide on the fibrous material, is selected from the group consisting of glass wool, rock wool, and carbon fibers, the most preferred fiber being glass wool.

Among other factors, the present invention provides a simple, effective method for removing iron from hydrocarbon feeds under relatively low temperature and pressure, and in the absence of hydrogen.

DETAILED DESCRIPTION OF THE INVENTION

Various petroleum crude feedstocks and residua produced from them contain unacceptably high levels of iron-containing metals contaminants. These contaminants are soluble, generally organic and non-porphyrinic. These metallic ions, especially organically-bound naphthenic compounds, cause distinct processing difficulties in standard catalytic hydrocarbon processing techniques, ordinarily by effecting rapid deactivation or fouling of the catalyst. This invention comprises a method for removing those iron-containing contaminants prior to catalytic processing of the feedstock by using an inert material on which the iron-containing compounds can react with sulfur or sulfur-containing compounds and deposit on the inert material by autocatalytic homoepitaxy.

We have found that with our autocatalytic system on an inert fibrous substrate, we can take advantage of a natural tendency for metals deposits to form. This is facilitated by allowing abundant surface for the deposits to grow, as well as abundant volume to grow without interfering with liquid flow. This mechanism, wherein the metals contaminates react with other elements on the surface of an inert material, and then continue to deposit on the surface of itself, is called autocatalytic homoepitaxy.

Autocatalytic Homoepitaxy

While not being bound or limited by any specific mechanism, it is believed that a possible explanation for the formation of removable iron compounds in the present invention involves a process termed autocatalytic homoepitaxy. In this process, initially a low level of thermal demetalation and desulfurization occurs on the surfaces of the fibers by the reaction of some iron in the feed with sulfur or sulfur-containing compounds to form iron sulfide. Surprisingly, this deposited material is an active hydrodemetalation catalyst. Continued thermal desulfurization preferentially deposits more of this catalyst on the previously formed catalyst by the process of homoepitaxy. Thus the system becomes progressively more active for metal removal, i.e., autocatalytic to further iron sulfide formation.

In order to facilitate the autocatalytic homoepitaxy process, a source of sulfur must be present in the system. The preferred source of sulfur is the feed itself, since many, if not most, feeds contain some active sulfur. If necessary, sulfur can also be introduced into the system, preferably by the use of known sulfiding agents such as dimethyldisulfide (DMDS), butyl mercaptan, ethyl mercaptan, dimethyl sulfide, and di-t-nonylpolysulfide. It is believed that these compounds decompose under process conditions into active sulfur which reacts with iron to form iron sulfide.

Feedstocks

The invention can be applied to any hydrocarbonaceous feedstock containing an unacceptably high level of iron. Those feedstocks can include crude petroleum, especially from particular sources, such as San Joaquin Valley crude, including, for example, South Belridge, Carne Front, Cymric Heavy, Midway Sunset, or Shengli No.2 from China or mixtures thereof. Additionally, atmospheric or vacuum residua or solvent deasphalted oils derived from these crudes, also can have unacceptably high iron levels. It is within the contemplation of the invention that any other hydrocarbonaceous feedstocks, such as shale oil, liquefied coal, beneficiated tar sand, etc., which may also contain similar metals contaminants, may also be processed using this invention.

Fibrous Material

The fibrous material for the growth of the catalyst is any inert, non-reactive, preferably inorganic, material which can be easily contained to an appropriate volume within the reaction zone, but generally resists compression which undesirably limits its surface area. It must also resist fusion under reaction conditions of the present process. The preferred fibrous material is, but is not limited to, glass wool, rock wool, and carbon fibers. Glass wool is most preferred.

In order to maximize available surface area for the reaction between the iron contaminants and the sulfiding agent and subsequent deposition, the fibers must be thin, preferably less than about 0.0003 inches in diameter, and able to survive the reactor conditions without fusing. Moreover, the packing density of the fibers should be low, but with minimum wasted volume to permit efficient flow through the reaction zone and to avoid undesirable pressure drop. However, they should not be so low as to have too little exterior surface area for catalyst growth and the deposition of feed metals. Preferred ranges are 0.01 to 0.3 cubic centimeter of fibrous material per cubic centimeter of reactor volume. About 0.05 cc fibrous material/cc reactor volume is most preferred.

The use of the preferred fibrous material in the demetalation zone has a number of distinct advantages:

1. Low cost. Glass wool, for example, costs about 3 cents per pound.
2. Efficient metal loading. Metal concentrations are about the same throughout the demetalation zone. There is no need for diffusion into pores of the demetalation catalyst.
3. High metal capacity. The glass wool typically comprises only 1% to 30% by volume of the reactor, and therefore a large percentage of the reactor volume is available for the iron sulfide produced.
4. Easy disposal. The more highly concentrated metals allow for low-volume waste.
5. Easier metal recovery. The metals are not locked within an alumina or silica matrix, as in other demetalation systems.

It may also be advantageous to add catalytic metals to the autocatalytic system. Stainless steel wire or biscuits of stainless or carbon steel are preferred as solid additives. It is believed that the metals released by corrosion of the added materials may increase the activity of the system and its activation rate. Similarly, dissolved metals (Mo, Cr, Ni, and/or Fe) might be added to the feed to produce a similar effect.

Preferred Operating Conditions

In the demetalation zone, reactor temperatures should be relatively low relative to prior art processes, i.e., between 250° F. and 600° F., preferably between about 350° F. and 550° F. Operating at lower temperatures has the advantage of avoiding unnecessary heating means and materials handling difficulties which higher temperatures would induce.

Similarly, the ability to demetalate at relatively lower pressures within the system is also important to the success of the present process. The process contemplates the use of pressures generally lower than the prior art in order to minimize process difficulties and the expense resulting from high pressure processing. The preferred pressure is between about 0 to 200 psig, preferably between about 40 to 150 psig.

In order to avoid significant or disabling pressure drop is the system, an appropriate packing density with the reaction zone must also be maintained. This also allows for maximum contact between the feedstock and the fibrous material, thereby maximizing available surface area for contacting of the feed and extending the usable life of the fibrous material in the demetalation zone. The appropriate packing density is preferably between about 0.01 to 0.3 cubic centimeters of fibrous material per cubic centimeter of reaction zone volume. The more preferred packing density is around 0.05 cubic centimeters of fibrous material per cubic centimeter of reaction zone volume.

This process is especially useful prior to hydroprocessing catalysts and heat exchangers. For example, this process can be used prior to hydrocrackers, residuum desulfurizers, demetalation reactors, and hydrofiners. This process is also useful in preventing fouling of heat exchangers, and can, for example, be used prior to a crude unit.

It also contemplated and may be desirable to operate the system using a two-reactor system. One reactor would have fresh support material growing catalyst, while following this a second reactor would contain active catalyst already deposited on the support. When the second reactor is spent to a desired level, the catalyst and support are removed and replaced by the material in the first reactor. Fresh support is then added to the first reactor.

EXAMPLE

Example 1

In a stainless steel tube reactor, ¼ inch in diameter, a two-inch thick plug of glass wool weighing approximately 800 mg. and approximately 8μ in average diameter, wrapped in stainless steel wire was placed in a two-inch heated zone and held in place with coarse alundum. The glass wool filled approximately 15% of the reactor volume. A vacuum gas oil hydrocracker feed containing 1% sulfur which was doped with 100 ppm Fe from a 6% iron naphthenate solution was passed upflow through this reactor operating at 400° F., in the absence of hydrogen, at a flow rate of 4 cc/hour, and a LHSV of 2. The system achieved at least 75% iron removal by 100 hours, and activated to more than 90% removal by 200 hours. The system continued to remove more than 90% of the iron for an additional 120 hours, at which time the run was terminated. The iron concentrations in the feed and products were measured by X-ray fluorescence analysis. Optical microscopy analysis confirmed that iron monosulfide had deposited on the surfaces of the glass wool.

Example 2

A 6.6 foot long, ⅜ inch stainless steel reactor with a two inch internal diameter is filled with ½ inch sand at the reactor inlet (to trap particulates) and 1593 grams of glass wool. The reactor volume is 4.085 liters; the glass wool occupies 15% of that volume. 15.5 barrels per day of a vacuum gas oil feed containing less than 1 ppm iron and about 1% sulfur is fed to this reactor at a LHSV of 25 and a flow velocity of 165.5 ft/hr. the feed is passed through the reactor at about 400° F. to effect iron removal.

What is claimed is:

1. A process for the removal of iron from hydrocarbonaceous feedstock comprising passing said feedstock over a solid, inert fibrous material in a low pressure metals removal reaction zone, in the absence of externally-supplied hydrogen and at a temperature in the range of 250° F. to 600° F., wherein said iron reacts with sulfur or sulfur-containing compounds to form iron sulfide in the presence of said fibrous material, and said iron sulfide deposits on said fibrous material and subsequently on said iron sulfide itself.

2. The process as claimed in claim 1, wherein said fibrous material is selected from the group consisting of glass wool, rock wool, and carbon fibers.

3. The process as claimed in claim 2, wherein said fibrous material is glass wool.

4. The process as claimed in claim 1, wherein the average diameter of the fibers comprising said fibrous material is about 0.0003 inches or less, and able to survive the conditions of said process without fusing.

5. The process as claimed in any one of claims 1, 2, 3 or 4, wherein the packing density of said fibers is between about 0.01 to 0.3 cubic centimeter of said fibrous material per cubic centimeter of reaction zone volume.

6. The process as claimed in claim 5, wherein said packing density is about 0.05 cubic centimeter of said fibrous material per cubic centimeter of reaction zone volume.

7. The process as claimed in claim 1, wherein said temperature is in the range 350° F. to 550° F.

8. The process as claimed in claim 1, wherein the pressure at which said process is conducted is in the range 0 to 200 psi.

9. The process as claimed in claim 8, wherein said pressure is in the range 40 to 150 psi.

10. The process as claimed in claim 1, wherein the hydrocarbonaceous feedstock is selected from the group comprising: crude petroleum, atmospheric or vacuum residua, deasphalted oils from such feedstocks, shale oil, liquefied coal, and tar sand effluent.

11. The process as claimed in claim 1, wherein the process is used in a refinery system prior to units selected from the group consisting of hydrocrackers, residuum desulfurizers, demetalation reactors, hydrofiners, and crude units.

* * * * *